US009027444B2

(12) United States Patent
Chang

(10) Patent No.: US 9,027,444 B2
(45) Date of Patent: May 12, 2015

(54) RATCHET WRENCH

(76) Inventor: Chih-Ming Chang, Changhua County (TW)

( * ) Notice: Subject to any disclaimer, the term of this patent is extended or adjusted under 35 U.S.C. 154(b) by 217 days.

(21) Appl. No.: 13/558,848

(22) Filed: Jul. 26, 2012

(65) Prior Publication Data

US 2014/0026720 A1 Jan. 30, 2014

(51) Int. Cl.
*B25B 13/46* (2006.01)
*B25B 23/12* (2006.01)

(52) U.S. Cl.
CPC ..... *B25B 23/12* (2013.01); *B25B 13/463* (2013.01)

(58) Field of Classification Search
USPC ..... 81/60, 125, 124.4
See application file for complete search history.

(56) References Cited

U.S. PATENT DOCUMENTS

| | | | | | |
|---|---|---|---|---|---|
| 1,203,685 | A * | 11/1916 | Baker | ..... | 81/124.4 |
| 2,574,156 | A * | 11/1951 | Pechacek | ..... | 81/124.4 |
| 3,165,950 | A * | 1/1965 | Gooley et al. | ..... | 81/125 |
| 4,663,998 | A * | 5/1987 | Parsons et al. | ..... | 81/125 |
| 6,688,195 | B1 * | 2/2004 | Hsien | ..... | 81/60 |
| 7,380,481 | B2 * | 6/2008 | Barnett et al. | ..... | 81/60 |

* cited by examiner

*Primary Examiner* — Hadi Shakeri
(74) *Attorney, Agent, or Firm* — Muncy, Geissler, Olds & Lowe, P.C.

(57) ABSTRACT

A ratchet wrench includes a wrench body, a ratchet rotatably mounted in the wrench body and defining therein a through hole for accommodating a screw nut, a magnetic member mounted in the through hole, and one or multiple limiters mounted in the through hole of the ratchet to hold the magnetic member in place. Thus, the opposing ends of the ratchet can be selectively used to accommodate a mating screw nut and the accommodated screw nut can be secured in place inside the ratchet by the magnetic attractive force of the magnetic member, avoiding screw nut displacement or falling and facilitating the use of the ratchet wrench. Further, the ratchet can be configured to have a stepped through hole for selectively accommodating different sizes of screw nuts.

2 Claims, 3 Drawing Sheets

RATCHET WRENCH

BACKGROUND OF THE INVENTION

1. Field of the Invention

The present invention relates to ratchet wrenches and more particularly, to such a ratchet wrench, which uses a magnetic member to secure an attached screw nut in place by means of a magnetic attractive force.

2. Description of the Related Art

A conventional ratchet wrench is known comprising a wrench body and a ratchet rotatably mounted in one end of the wrench body. The ratchet is shaped like a double open end socket for accommodating a mating screw nut. The accommodated screw nut can be fastened tight or loosened when the user rotates the wrench body.

However, because the ratchet and the accommodated screw nut are loosely attached together, the screw nut may slip relative to the ratchet when the user rotates the wrench body. Therefore, the aforesaid conventional ratchet wrench is not convenient or very easy to use, and has a poor performance. Further, when the user removes the ratchet wrench from the screw nut after the screw nut has been fully loosened, the screw nut may fall to the ground, and the user needs to spend time searching the fallen screw nut. Therefore, the aforesaid conventional ratchet wrench is not convenient to use.

Further, Taiwan Utility M416520 discloses a ratchet wrench having an annular magnet mounted in one end of the wrench body for securing the attached screw nut in place by a magnetic attractive force to avoid screw nut displacement or falling. However, this design of ratchet wrench simply allows loading of a screw nut into the ratchet through the other end of the ratchet without the annular magnet. Therefore, this design of ratchet wrench is less convenient to use. Further, this design of ratchet wrench is not suitable for use with a ratchet having different inner diameters in opposing ends.

SUMMARY OF THE INVENTION

The present invention has been accomplished under the circumstances in view. It is the main object of the present invention to provide a ratchet wrench, which uses a ratchet configured for selectively accommodating a screw nut in either of two opposing ends thereof, and a magnetic member to secure the attached screw nut in place by a magnetic attractive force, wherein the ratchet can be configured having a stepped through holes for selectively accommodating two different sizes of screw nuts.

To achieve this and other objects of the present invention, a ratchet wrench comprises a wrench body, a ratchet, and a magnetic member. The ratchet is rotatably mounted in the wrench body, defining therein a through hole for accommodating a screw nut. The magnetic member is mounted in the through hole and stopped in place by one or multiple limiters. Thus, the opposing ends of the ratchet can be selectively used to accommodate a mating screw nut, and the accommodated screw nut can be secured in place inside the ratchet by the magnetic attractive force of the magnetic member, avoiding screw nut displacement or falling and facilitating the use of the ratchet wrench. Further, the ratchet can be configured to have a stepped through hole for selectively accommodating different sizes of screw nuts.

Other advantages and features of the present invention will be fully understood by reference to the following specification in conjunction with the accompanying drawings, in which like reference signs denote like components of structure.

DETAILED DESCRIPTION OF THE INVENTION

Figure 1:
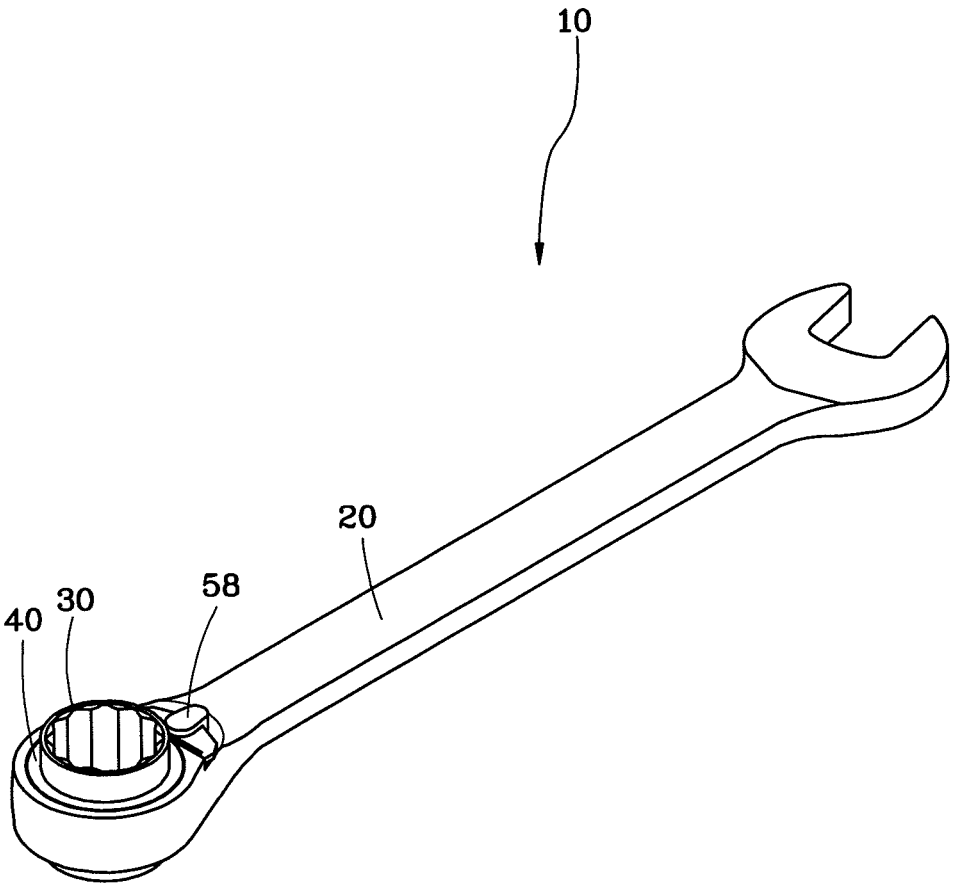
FIG. 1 is an elevational assembly view of a ratchet wrench in accordance with a first embodiment of the present invention.
Figure 2:
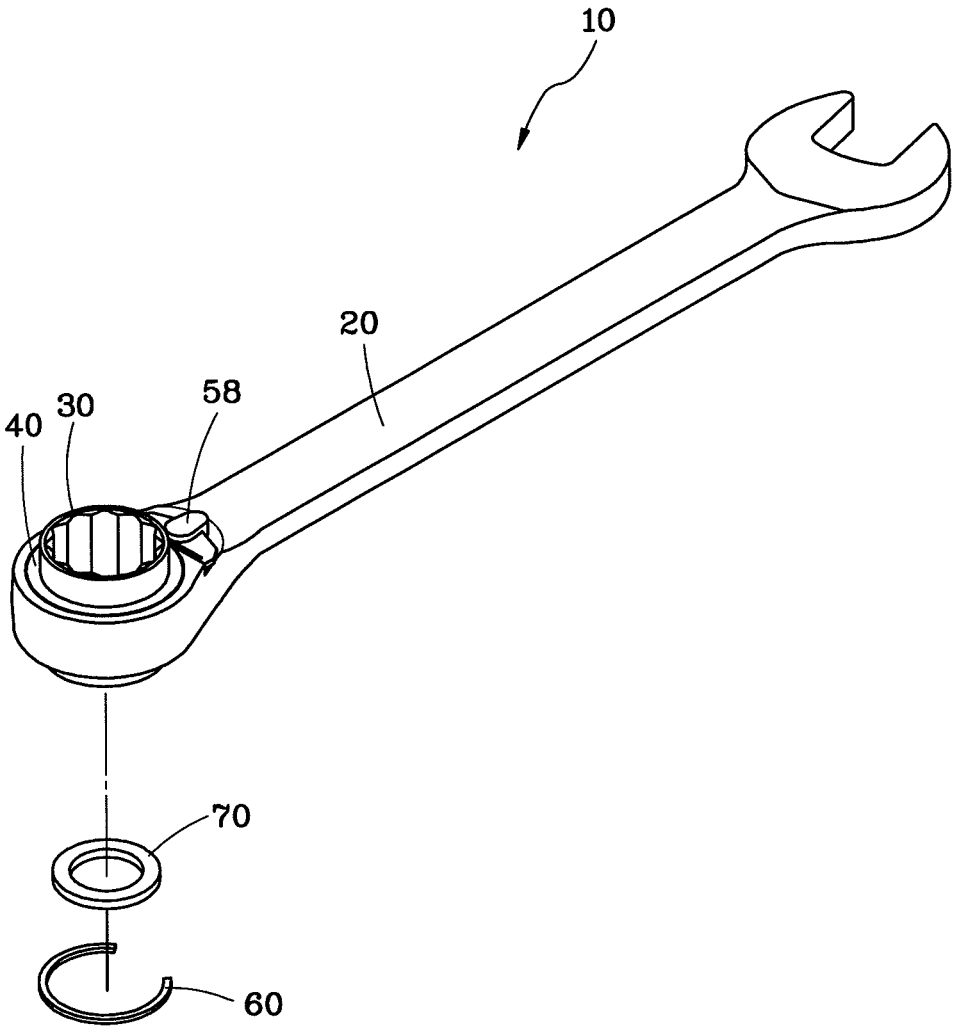
FIG. 2 is an exploded view of the ratchet wrench in accordance with the first embodiment of the present invention.
Figure 3:
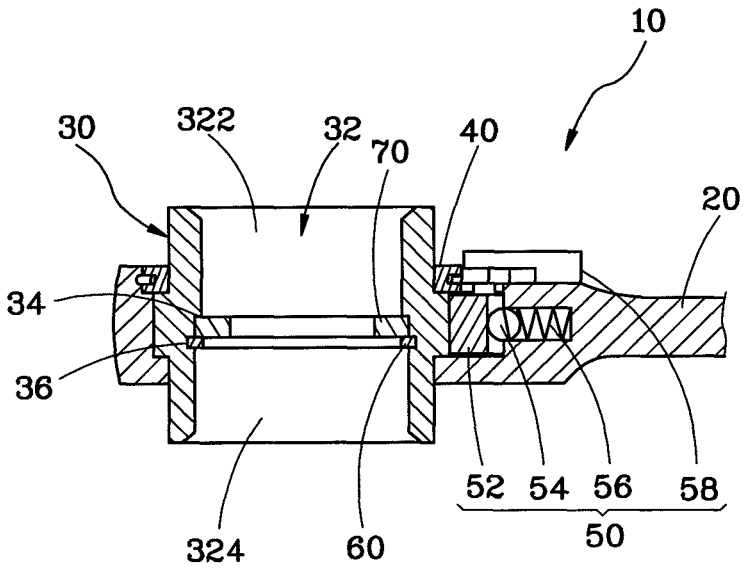
FIG. 3 is a partial sectional view of the ratchet wrench in accordance with the first embodiment of the present invention.

Referring to FIGS. 1-3, a ratchet wrench 10 in accordance with a first embodiment of the present invention is shown. The ratchet wrench 10 comprises a wrench body 20, a ratchet 30, an annular cap 40, a brake 50, a limiter 60, and a magnetic member 70.

The configurations of the wrench body 20, ratchet 30, annular cap 40 and brake 50 of the ratchet wrench 10 and their relative relationship are similar to an equivalent conventional design. The ratchet 30 is shaped like a double open end socket, defining therein a through hole 32 for accommodating a screw nut (not shown). The ratchet 30 is rotatably held down in one end of the wrench body 20. The brake 50 comprises a pawl 52 engageable with the ratchet 30, a steel ball 54 supported between the pawl 52 and the wrench body 20, and an elastic member 56 supported between the steel ball 54 and the wrench body 20. Thus, the ratchet 30 can simply be rotated in one direction relative to the wrench body 20. In this embodiment, the brake 50 further comprises a switching member 58 operable by a user to switch rotation of the ratchet 30 relative to the wrench body 20 between two reversed directions. However, this design is not a limitation. The ratchet wrench 10 can also be configured without the switching member 58, limiting the rotation of the ratchet 30 to one direction only. Further, in this embodiment, the ratchet 30 has its two opposing ends protruding out of the wrench body 20. However, this protruding design is not a limitation.

In this embodiment, the through hole 32 of the ratchet 30 is a stepped hole comprising a small diameter portion 322, a large diameter portion 324, a step 34 connected between the small diameter portion 322 and the large diameter portion 324, and an annular groove 36 located on the large diameter portion 324. The limiter 60 is a C-shaped retaining ring set in the annular groove 36. The magnetic member 70 is an annular magnet set between the step 34 and the limiter 60. Thus, the small diameter portion 322 and large diameter portion 324 of the ratchet 30 can accommodate a respective mating screw nut, and the accommodated screw nut can be secured in place inside the ratchet 30 by the magnetic attractive force of the magnetic member 70, avoiding screw nut displacement or falling and facilitating the use of the ratchet wrench 10.

Figure 4:
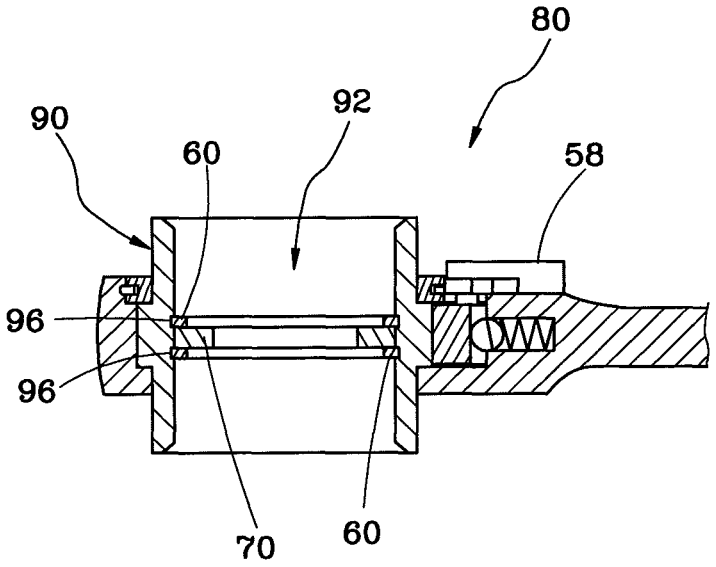
FIG. 4 is a partial sectional view of the ratchet wrench in accordance with a second embodiment of the present invention.

Referring to FIG. 4, a ratchet wrench 80 in accordance with a second embodiment of the present invention is shown. This ratchet wrench 80 uses a ratchet 90 having a through hole of uniform diameter. As illustrated, the ratchet 90 comprises two annular grooves 96 formed in the through hole 92 thereof at different elevations. Further, two limiters 60 are respectively mounted in the annular grooves 96. Further, a magnetic member 70 is set in the through hole 92 of the ratchet 90 between the two limiters 60. Each of the limiters 60 has an inner diameter smaller than the diameter of the through hole 92. Thus, a user can operate the switching member 58 to switch the rotation of the ratchet 90 to the desired direction, or turn the ratchet wrench 80 upside down to change the direction of rotation of the ratchet 90 relative to the wrench body 20. Thus, the ratchet wrench 80 is ease of use.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wrench, comprising:

a wrench body;

a ratchet rotatably mounted in said wrench body, said ratchet comprising a through hole for accommodating a screw nut;

a magnetic member mounted in said through hole; and at least one limiter holding said magnetic member in said through hole;

wherein the number of said at least one limiter is 2; said magnetic member is stopped between the two limiters in said through hole of said ratchet, said through hole of said ratchet has a uniform diameter; said ratchet further comprises two annular grooves formed in said through hole at different elevations; said two limiters are C-shaped retaining rings respectively mounted in said two annular grooves to hold said magnetic member therebetween; each of the limiters has an inner diameter smaller than the diameter of the through hole.

2. The ratchet wrench as claimed in claim 1, wherein said ratchet protrudes out of said wrench body.

* * * * *